US008747284B2

(12) United States Patent
Ingram

(10) Patent No.: US 8,747,284 B2
(45) Date of Patent: Jun. 10, 2014

(54) LIFTING STRAP WITH ENHANCED GRIPPING PROPERTIES

(75) Inventor: Kenneth Robert Ingram, Kitchener (CA)

(73) Assignee: McCrane, Inc., Fairfield, CA (US)

( * ) Notice: Subject to any disclaimer, the term of this patent is extended or adjusted under 35 U.S.C. 154(b) by 1808 days.

(21) Appl. No.: 11/564,118

(22) Filed: Nov. 28, 2006

(65) Prior Publication Data

US 2008/0125295 A1 May 29, 2008

(51) Int. Cl.
*A63B 23/16* (2006.01)
*A63B 21/072* (2006.01)
*A63B 21/075* (2006.01)

(52) U.S. Cl.
USPC ..... 482/50; 482/106

(58) Field of Classification Search
USPC ..... 482/13, 44–50, 92–139, 34, 82
See application file for complete search history.

(56) References Cited

U.S. PATENT DOCUMENTS 3,175,559 A * 3/1965 Kane ..... 450/31
3,498,410 A * 3/1970 Storch ..... 182/96
3,712,689 A * 1/1973 Chaumont ..... 305/166
3,893,604 A * 7/1975 Skinner ..... 224/257
4,044,437 A * 8/1977 Ebenstein ..... 28/151
4,052,095 A * 10/1977 Johnson ..... 294/74
4,161,195 A * 7/1979 Khan ..... 139/383 A
4,200,325 A * 4/1980 Johnson ..... 294/74
4,430,990 A * 2/1984 Whitehead ..... 601/45
4,524,760 A * 6/1985 Lerner ..... 128/845
4,599,920 A * 7/1986 Schmid ..... 81/489
4,660,497 A * 4/1987 Cochran ..... 114/345
4,684,559 A 8/1987 Wasko
4,775,345 A * 10/1988 Gifford ..... 441/75
4,793,005 A * 12/1988 Hetzel, Jr. ..... 2/161.1
4,809,974 A * 3/1989 Buhr ..... 482/139
4,834,439 A * 5/1989 van de Kamp ..... 294/74
4,843,651 A * 7/1989 Gramza et al. ..... 2/161.1
4,900,613 A * 2/1990 Green ..... 442/189
4,958,384 A * 9/1990 McCrane ..... 2/161.6
5,004,231 A * 4/1991 Alread ..... 482/139
5,070,866 A * 12/1991 Alexander et al. ..... 602/19
5,127,109 A * 7/1992 Heitzman-Powell et al. .... 2/409
5,219,636 A * 6/1993 Golz ..... 428/193
5,238,279 A * 8/1993 Anteau ..... 294/74
5,272,796 A * 12/1993 Nichols ..... 24/712
5,292,328 A * 3/1994 Hain et al. ..... 606/151
5,324,244 A 6/1994 Miller et al.
5,353,440 A * 10/1994 Meldeau ..... 2/161.1
5,362,295 A * 11/1994 Nurge ..... 482/124
5,388,743 A * 2/1995 Silagy ..... 224/264
5,419,951 A * 5/1995 Golz ..... 442/200
5,447,498 A * 9/1995 Watson ..... 602/19
5,500,952 A * 3/1996 Keyes ..... 2/465
5,551,447 A * 9/1996 Hoffman et al. ..... 128/869
5,557,806 A * 9/1996 Caswell et al. ..... 2/161.1
5,634,213 A * 6/1997 Grover ..... 2/161.1
5,688,011 A * 11/1997 Gulley ..... 294/74
5,732,662 A * 3/1998 Jacobsen ..... 119/798

(Continued)

*Primary Examiner* — Robert Long
(74) *Attorney, Agent, or Firm* — Edward S. Wright

(57) ABSTRACT

Weight lifting strap which is looped around the wrist and wrapped in helical fashion about a weight lifting bar or the like and gripped by the hand with opposite sides of the strap facing the bar and the hand, and the strap being fabricated of a woven material with rubberized strands on the side of the strap which faces the bar.

13 Claims, 4 Drawing Sheets

(56) References Cited

U.S. PATENT DOCUMENTS

| | | | | | |
|---|---|---|---|---|---|
| 5,737,773 | A * | 4/1998 | Dicker et al. | 2/69 |
| 5,745,920 | A * | 5/1998 | Olivier | 2/170 |
| 5,746,685 | A * | 5/1998 | Glaser | 482/93 |
| 5,772,537 | A * | 6/1998 | Anderson et al. | 473/435 |
| 5,809,570 | A * | 9/1998 | Grover | 2/161.1 |
| 5,820,526 | A * | 10/1998 | Hoffman | 482/55 |
| 5,888,180 | A * | 3/1999 | Dewberry | 482/139 |
| 5,894,976 | A * | 4/1999 | Harper | 224/587 |
| 5,927,297 | A * | 7/1999 | Cooper | 132/273 |
| 5,994,612 | A * | 11/1999 | Watkins | 602/41 |
| 6,138,285 | A * | 10/2000 | Robrahn et al. | 2/436 |
| 6,146,319 | A * | 11/2000 | Tarail | 482/139 |
| 6,149,215 | A * | 11/2000 | Balogh et al. | 294/74 |
| 6,168,556 | B1 * | 1/2001 | Saavedra | 482/93 |
| 6,216,636 | B1 * | 4/2001 | Butchko | 119/497 |
| 6,231,488 | B1 * | 5/2001 | Dicker et al. | 482/124 |
| 6,298,488 | B1 * | 10/2001 | Duncan et al. | 2/158 |
| D459,772 | S * | 7/2002 | Meldeau | D21/662 |
| D464,686 | S * | 10/2002 | Silveira et al. | D21/662 |
| 6,553,574 | B1 * | 4/2003 | Hall et al. | 2/160 |
| 6,564,385 | B2 * | 5/2003 | McCarthy | 2/16 |
| 6,626,335 | B1 * | 9/2003 | Dunlop | 224/258 |
| 6,687,916 | B2 * | 2/2004 | Thompson | 2/170 |
| 6,704,939 | B2 | 3/2004 | Faulconer | |
| 6,736,263 | B1 * | 5/2004 | Smith | 206/315.1 |
| 6,895,601 | B2 * | 5/2005 | Park | 2/181 |
| 6,898,802 | B1 * | 5/2005 | Suarkeo | 2/20 |
| 6,990,689 | B1 * | 1/2006 | Thellmann | 2/161.1 |
| 7,004,889 | B2 * | 2/2006 | McBride | 482/92 |
| 7,041,032 | B1 * | 5/2006 | Calvano | 482/4 |
| D525,323 | S * | 7/2006 | Dwars | D21/662 |
| 7,118,516 | B1 * | 10/2006 | Gouthro | 482/92 |
| 7,275,729 | B2 * | 10/2007 | Sherman et al. | 248/311.2 |
| 7,419,198 | B2 * | 9/2008 | Baker et al. | 294/74 |
| 7,490,634 | B2 * | 2/2009 | Resendez et al. | 139/423 |
| 7,537,577 | B2 * | 5/2009 | Phelan et al. | 602/21 |
| 2003/0119632 | A1 * | 6/2003 | Archuleta | 482/49 |
| 2004/0209534 | A1 * | 10/2004 | Graham | 441/64 |
| 2005/0204501 | A1 * | 9/2005 | Golec | 15/209.1 |
| 2005/0277491 | A1 * | 12/2005 | Nolan | 473/451 |
| 2006/0081748 | A1 * | 4/2006 | Sherman et al. | 248/309.1 |
| 2006/0081749 | A1 * | 4/2006 | Sherman et al. | 248/309.1 |
| 2006/0186150 | A1 * | 8/2006 | Willows et al. | 224/222 |
| 2006/0255214 | A1 * | 11/2006 | Simone | 248/102 |
| 2007/0118966 | A1 * | 5/2007 | Beraznik | 2/159 |
| 2007/0197859 | A1 * | 8/2007 | Schaer et al. | 600/37 |
| 2008/0009398 | A1 * | 1/2008 | Grisdale | 482/124 |
| 2008/0085817 | A1 * | 4/2008 | Brentlinger et al. | 482/55 |
| 2008/0120755 | A1 * | 5/2008 | Ingram et al. | 2/20 |
| 2008/0256688 | A1 * | 10/2008 | Bruce | 2/441 |
| 2008/0296325 | A1 * | 12/2008 | Tepper | 224/148.6 |
| 2009/0011869 | A1 * | 1/2009 | Bozof | 473/424 |
| 2009/0090378 | A1 * | 4/2009 | Chudzik et al. | 132/273 |
| 2009/0162651 | A1 * | 6/2009 | Rios et al. | 428/354 |

* cited by examiner

LIFTING STRAP WITH ENHANCED GRIPPING PROPERTIES

BACKGROUND OF THE INVENTION

1. Field of Invention

This invention pertains generally to weight lifting and fitness equipment and, more particularly, to a strap for improving the grip on such equipment.

2. Related Art

Lifting straps are used as an aid in weight lifting and fitness exercises to improve the user's grip on a bar and to allow him to concentrate on the muscles he wants to exercise rather than the ones which would otherwise be used in gripping the bar. The strap is typically looped about the wrist and then wrapped about the bar where it is gripped by the hand. Examples of such straps are found in U.S. Pat. Nos. 4,809,974, 5,324,254, 5,745,920 and 7,004,889.

OBJECTS AND SUMMARY OF THE INVENTION

It is in general an object of the invention to provide a new and improved strap for use in weight lifting and the like.

Another object of the invention is to provide a lifting strap of the above character which overcomes the limitations and disadvantages of the prior art.

These and other objects are achieved in accordance with the invention by providing a weight lifting strap which is wrapped in helical fashion about a bar and gripped by a hand with opposite sides of the strap facing the bar and the hand, and the strap being fabricated of a woven material with rubberized strands on the side of the strap which faces the bar.

DETAILED DESCRIPTION

Figure 1:
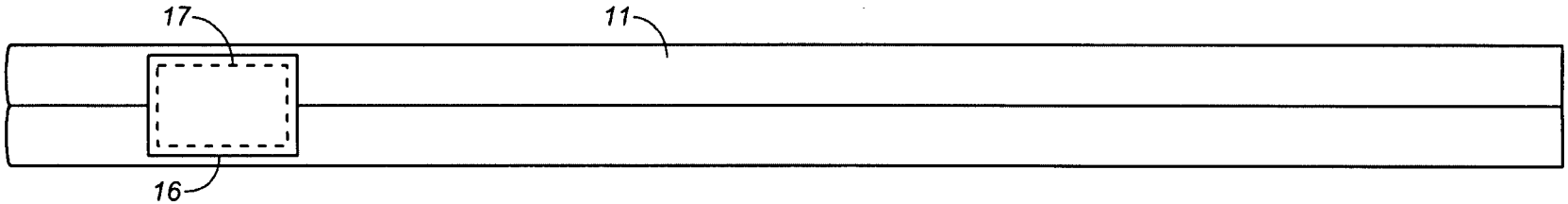
FIGS. 1 and 2 are front and rear elevational views of one embodiment of a lifting strap according to the invention.

As illustrated in the drawings, lifting strap 11 is woven of a durable, flexible material such as nylon, with strands 12 of a rubberized material in the weave on the back side of the strap. At one end of the strap, the end portion 13 is folded back upon itself and stitched to form a loop 14, with the rubberized strands on the inner side of the loop. A label 16 is affixed to the front side of the strap near the loop and, in the embodiment illustrated, is secured to the strap by the same stitches 17 that form the loop.

Figure 3:
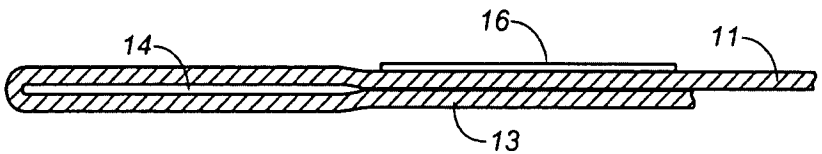
FIG. 3 is a fragmentary side elevational view of the embodiment of FIGS. 1 and 2.
Figure 4:
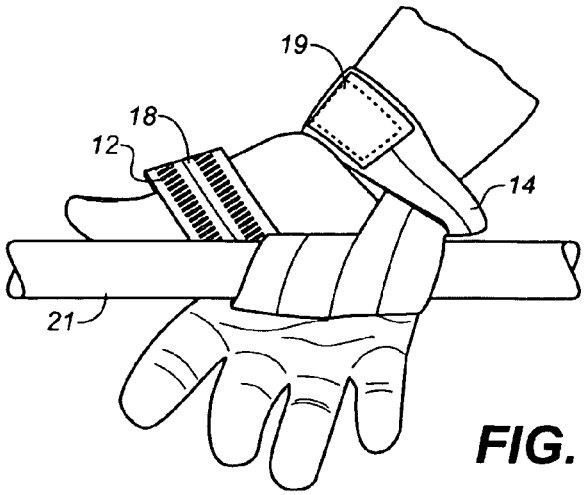
FIG. 4 is an isometric view illustrating use of the embodiment of FIGS. 1 and 2.
Figure 5:
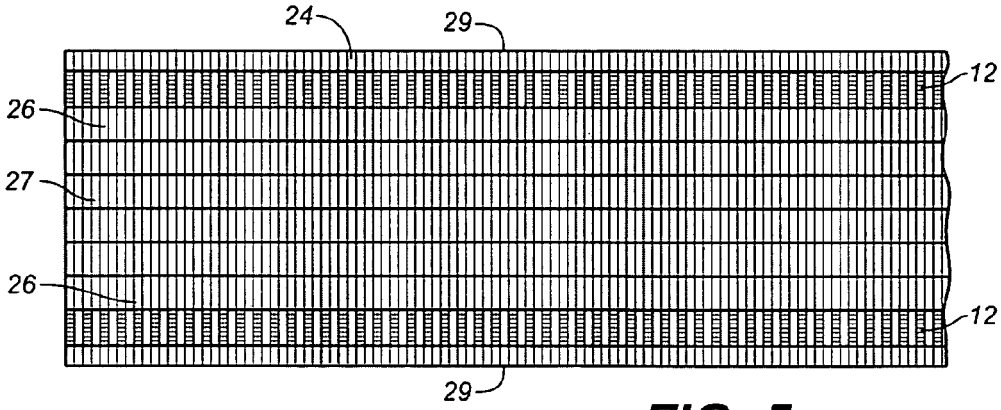
FIG. 5 is a fragmentary plan view of a web of woven material from which the embodiment of FIGS. 1 and 2 is made.
Figure 6:
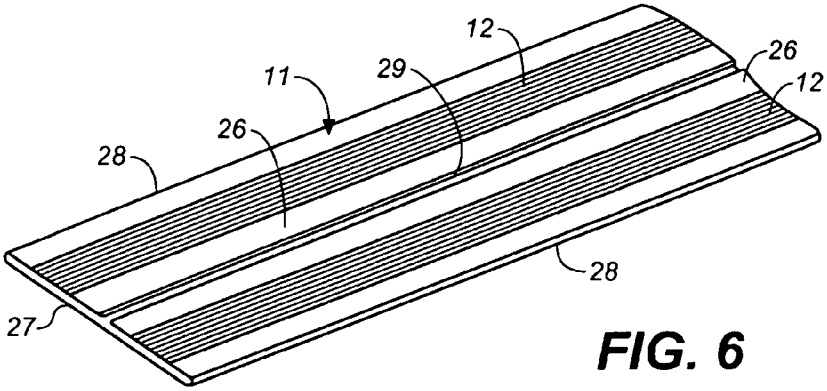
FIG. 6 is a fragmentary isometric view of the web of FIG. 5 being folded to form the embodiment of FIGS. 1 and 2.

The strap typically has a length on the order of 20-22 inches and a width on the order of 1.5 inches. As illustrated in FIG. 3, it is looped about the wrist of a user by passing the free end 18 of the strap through loop 14 to form a larger loop 19 which encircles the wrist, with the free portion of the strap and being wrapped in helical fashion about a weight lifting bar 21, or the like, with the rubberized strands 12 facing the bar.

The rubberized strands extend lengthwise of the strap and provide enhanced gripping properties for the side of the strap which faces the object be gripped. In the embodiment illustrated, the rubberized strands are arranged in two groups 22 of eight strands each, and the two groups are disposed side-by-side and spaced laterally apart along the strap.

Figure 2:
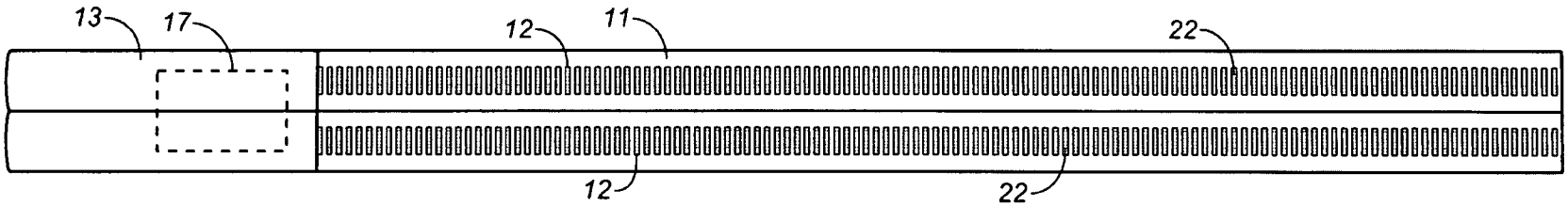

In the embodiment of FIGS. 1 and 2, the strap is made from a web 24 of woven fabric which is approximately twice as wide as the finished strap, with the two groups of rubberized strands 12 in lateral edge portions 26 of the web. The edge portions are approximately one-fourth as wide as the web and half as wide as the finished strap, and they are folded over the central portion 27 of the web along longitudinally extending fold lines 28, with the selvedge edges 29 of the web coming together near the longitudinal centerline of the strap. The folded-over edge portions are secured to the central portion by suitable means such as over-weaving or stitching to form a substantially flat two layer strap, with the central portion of the web serving as a base for the layer with the rubberized strands.

Once the two layer structure has been formed, it is cut into lengths for the individual straps, and the raw ends of the individual straps are stitched to prevent them from fraying. One end portion of each strap is then folded over and stitched to itself to form loop 14 and to secure label 16 to the strap.

Figure 7:
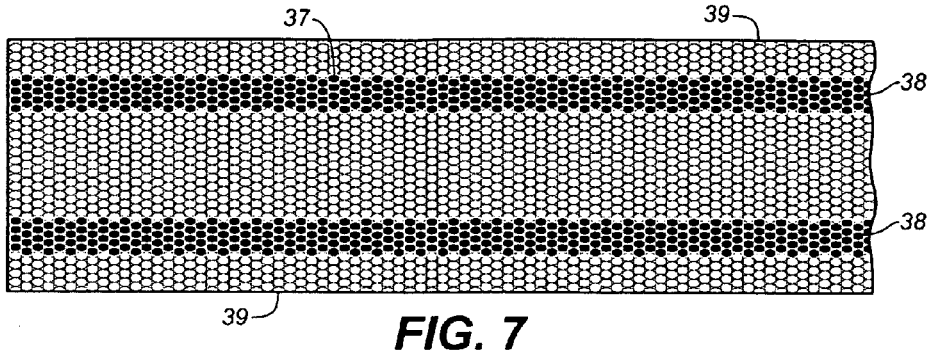
FIGS. 7 and 8 are top and bottom plan views of another embodiment of a woven material for use in a lifting strap according to the invention.
Figure 8:
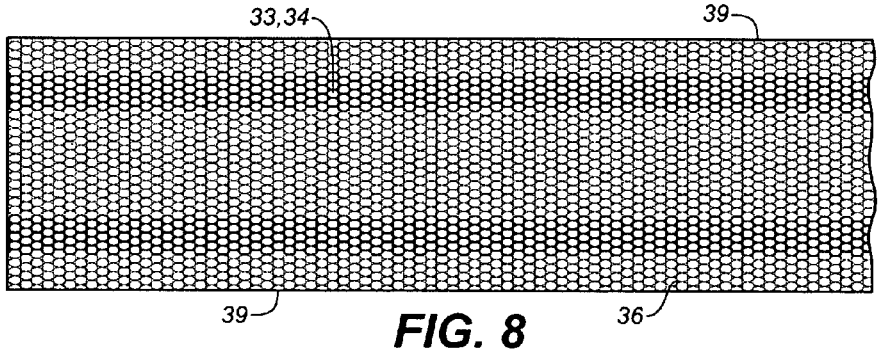
Figure 9:
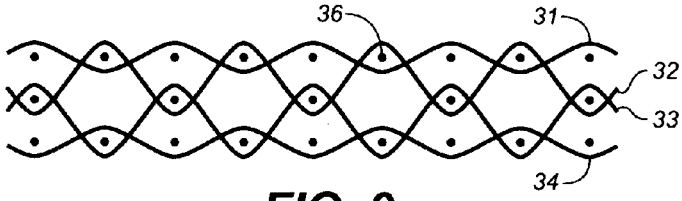
FIGS. 9 and 10 are fragmentary cross-sectional views of the embodiment of FIGS. 7 and 8.
Figure 10:
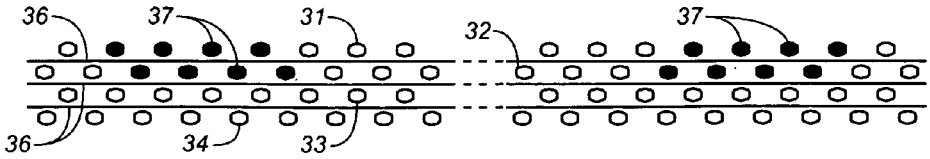

In the embodiment of FIGS. 7 and 8, the material is a flat, multi-layer woven fabric with rubberized strands in the top layer only. In this material, four layers of warp strands 31, 32, 33, 34 are woven together in an over-under pattern with a weft strand 36 which is common to all of the layers. As best seen in FIG. 9, the two uppermost layers 31, 32 are woven together, as are the two lowermost layers 33, 34. Inner layers 32, 33 are also woven together to form an interlocking structure. Rubberized strands 37 are included in the top layer of warp strands and are woven only with the strands in the second layer. Hence, the rubberized strands are confined to the top layer of the weave and do not go all the way through the material.

In this embodiment rubberized strands 37 are arranged in two groups 38, 38 of eight strands each near the edges 39 of the material.

When formed into a lifting strap, the flat interwoven fabric is positioned with the rubberized strands on the back side of the strap. Then, as described above, one end portion of the strap is folded back upon itself and stitched to form a loop, with the rubberized strands on the inner side of the loop, and a label is affixed to the front side of the strap near the loop. This strap is used in the same manner as the embodiment of FIGS. 1 and 2.

Figure 11:
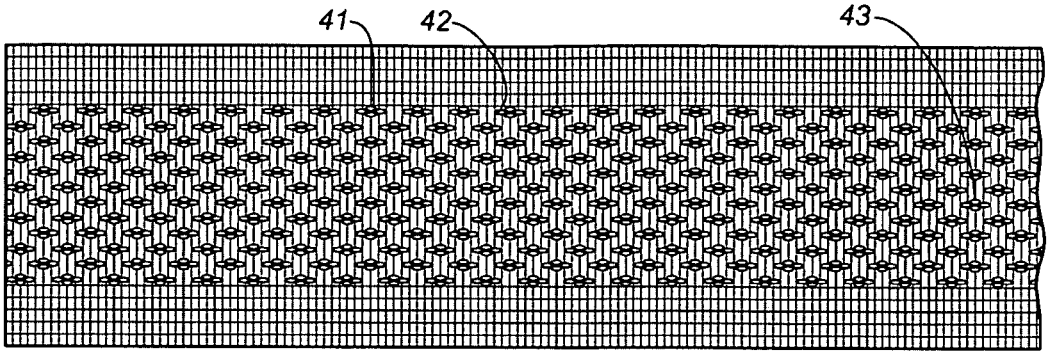
FIGS. 11 and 12 are top and bottom plan views of another embodiment of a woven material for use in a lifting strap according to the invention.
Figure 12:
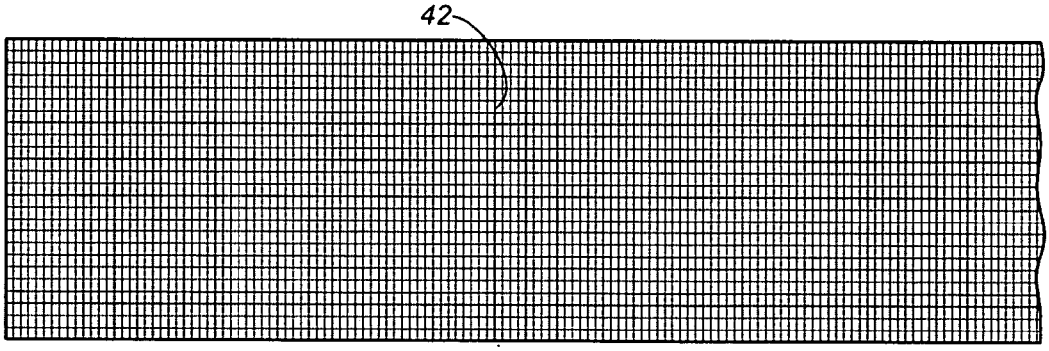

The embodiment of FIGS. 11 and 12 is similar to the embodiment of FIGS. 7 and 8 except for the number and the location of the rubberized warp strands in the upper layer of the fabric. In this embodiment, the rubberized strands 41 are arranged in groups of three, with non-rubberized strands 42 between the groups, and woven into a diamond shaped pattern in the central portion 43 of the fabric. This material is used in the same manner as the embodiment of FIGS. 7 and 8 in making a strap, with the rubberized strands on the back side of the strap for engagement with the bar or object to be lifted.

The invention has a number of important features and advantages. The rubberized strands facing the bar provide enhanced gripping properties with better control and greater safety in the lifting of heavier weights.

It is apparent from the foregoing that a new and improved lifting strap has been provided. While only certain presently preferred embodiments have been described in detail, as will be apparent to those familiar with the art, certain changes and modifications can be made without departing from the scope of the invention as defined by the following claims.

The invention claimed is:

1. A lifting strap comprising an elongated length of flexible fabric with strands having enhanced gripping properties woven into the fabric on one side of the strap, an end portion of the strap being folded back upon and secured to itself to form a loop with the strands having enhanced gripping properties on the inner side of the loop, and the remainder of the strap being passed through the loop to form a larger loop for encircling the wrist of a person and extending therefrom in position to be wrapped about an object with the strands having enhanced gripping properties facing the object.

2. The lifting strap of claim 1 wherein the fabric is nylon.

3. The lifting strap of claim 1 wherein the strands having enhanced gripping properties are fabricated of rubber.

4. The lifting strap of claim 1 wherein the strands having enhanced gripping properties extend lengthwise of the strap.

5. The lifting strap of claim 1 wherein the strands having enhanced gripping properties are arranged in two groups disposed toward opposite edges of the strap.

6. The lifting strap of claim 1 wherein the strap has two superposed layers, with the strands having enhanced gripping properties being woven into only one of the layers.

7. The lifting strap of claim 1 wherein the strap is formed from a web of fabric having two groups of strands with enhanced gripping properties woven therein, with one portion of the web being folded over another to form a two layer structure with the two groups of strands disposed side by side in one of the layers.

8. The lifting strap of claim 7 wherein the strands with enhanced gripping properties are woven into edge portions of the web, and the edge portions are folded over a central portion.

9. A weight lifting strap which is wrapped in helical fashion about a bar and gripped by a hand with opposite sides of the strap facing the bar and the hand, the strap being fabricated of a woven material with rubberized strands woven into the material on the side which faces the bar but not on the side which faces the hand; wherein the strap is formed from a web of fabric having two groups rubberized strands woven therein, with one portion of the web being folded over another to form a two layer structure with the two groups of rubberized strands disposed side by side in one of the layers.

10. The lifting strap of claim 9 wherein the rubberized strands are woven into edge portions of the web, and the edge portions are folded over a central portion.

11. A lifting strap comprising an elongated web of flexible woven material having lateral edge portions folded inwardly and over a central portion to form a substantially flat, two layer structure, with rubberized strands woven into the lateral edge portions providing enhanced gripping properties on one side of the strap and one end portion of the strap being folded back upon itself to form a loop with the rubberized strands on the inner side of the loop.

12. A lifting strap comprising an elongated web of flexible woven material having lateral edge portions folded inwardly and over a central portion to form a substantially flat, two layer structure, with rubberized strands woven into the lateral edge portions providing enhanced gripping properties on one side of the strap, and a label affixed to the strap on the side opposite the rubberized strands.

13. A lifting strap comprising an elongated web of woven fabric having a first layer of warp strands which includes strands having enhanced gripping properties, a second layer of warp strands below the first layer, a third layer of warp strands below the second layer, and a fourth layer of warp strands below the third layer, with the warp strands in the first and second layers being woven together with a weft strand, the warp strands in the second and third layers being woven together with a weft strand, and the warp strands in the third and fourth layers being woven together with a weft strand to form an interlocking structure with the strands having enhanced gripping properties in an outermost layer to provide enhanced gripping properties on one side of the strap.

* * * * *